US009346271B2

(12) United States Patent
Kobayashi et al.

(10) Patent No.: US 9,346,271 B2
(45) Date of Patent: May 24, 2016

(54) LIQUID EJECTING HEAD

(71) Applicant: Seiko Epson Corporation, Tokyo (JP)

(72) Inventors: Hiroyuki Kobayashi, Azumino (JP); Hiroshige Owaki, Okaya (JP); Toshinobu Yamazaki, Niigata (JP); Hiroyuki Hagiwara, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/751,949

(22) Filed: Jun. 26, 2015

(65) Prior Publication Data

US 2016/0031210 A1 Feb. 4, 2016

(30) Foreign Application Priority Data

Jul. 29, 2014 (JP) ..... 2014-153553

(51) Int. Cl.
*B41J 2/165* (2006.01)
*B41J 2/14* (2006.01)
*B41J 2/16* (2006.01)

(52) U.S. Cl.
CPC ..... *B41J 2/1433* (2013.01); *B41J 2/165* (2013.01); *B41J 2/1623* (2013.01); *B41J 2/16508* (2013.01)

(58) Field of Classification Search
CPC ..... B41J 2/1623; B41J 2/162; B41J 2/16508; B41J 2/16505; B41J 2/155
See application file for complete search history.

(56) References Cited

U.S. PATENT DOCUMENTS

2007/0165070 A1* 7/2007 Honma ..... B41J 2/14024 347/47
2008/0284819 A1* 11/2008 Owaki ..... B41J 2/14233 347/44
2008/0284826 A1* 11/2008 Owaki ..... B41J 2/14233 347/71
2009/0058935 A1 3/2009 Owaki

FOREIGN PATENT DOCUMENTS

JP 5136752 B2 2/2013

* cited by examiner

*Primary Examiner* — Geoffrey Mruk
(74) *Attorney, Agent, or Firm* — Harness, Dickey & Pierce, P.L.C.

(57) ABSTRACT

A liquid ejecting head includes a fixing plate which includes a bottom surface which is fixed onto the nozzle surface of each of a plurality of head units which are provided to line up in a state in which a first gap is formed along a first direction, and a first side surface which extends from an edge of the bottom surface which is positioned closer to an outside in the first direction than the lined-up head units to the head unit side. The fixing plate includes a second gap which is formed between the first side surface and the head units which are positioned at ends in the first direction among the head units. The liquid ejecting head also includes a second outer circumferential mold which fills at least a portion of the first gap, and a third outer circumferential mold which fills at least a portion of the second gap. The third outer circumferential mold fills the second gap at a position which is distanced further from the bottom surface than the second outer circumferential mold in a direction which is perpendicular to the bottom surface, and a hardness of the third outer circumferential mold is higher than a hardness of the second outer circumferential mold.

10 Claims, 7 Drawing Sheets

LIQUID EJECTING HEAD

CROSS REFERENCES TO RELATED APPLICATIONS

This application claims priority to Japanese Patent Application No. 2014-153553 filed on Jul. 29, 2014. The entire disclosures of Japanese Patent Application No. 2014-153553 is hereby incorporated herein by reference.

BACKGROUND

1. Technical Field

The present invention relates to a liquid ejecting head such as an ink jet recording head which is provided with a plurality of head units which eject a liquid from nozzles.

2. Related Art

An image recording head is an example of an ink jet recording head which is used in an image recording apparatus such as an ink jet recording apparatus; however, recently liquid ejecting heads are also being adapted for use in various manufacturing apparatuses, making use of the characteristic of being capable of causing extremely small amounts of a liquid to accurately land in predetermined positions. For example, the liquid ejecting head is being adapted for use in display manufacturing apparatuses which manufacture color filters of liquid crystal displays and the like, electrode forming apparatuses which form electrodes of organic electro-luminescence (EL) displays, face emission displays (FED), and the like, and chip manufacturing apparatuses which manufacture biochips (biochemical elements). In a recording head for an image recording apparatus, a liquid-state ink is ejected, and in a color material ejecting head for a display manufacturing apparatus, solutions of color materials for each of red (R), green (G), and blue (B) are ejected. In an electrode material ejecting head for an electrode forming apparatus, a liquid-state electrode material is ejected, and in a bio-organic matter ejecting head for a chip manufacturing apparatus, a solution of bio-organic matter is ejected.

Among the liquid ejecting heads described above, there is a liquid ejecting head which is provided with a plurality of head units which include a plurality of nozzles which are formed in a nozzle surface, a pressure chamber which is formed for each nozzle, and actuators such as piezoelectric elements which cause changes in pressure inside each of the pressure chambers. The plurality of head units are adhesively fixed to a fixing plate from the nozzle surface side. The fixing plate is formed such that the edge portion of the bottom surface to which the nozzle surface is fixed is folded to the head unit side and surrounds the head units. There is a liquid ejecting head in which a gap between the side surfaces of the head units and the side surfaces of the fixing plate which is folded along the side surfaces of the head unit is filled with plural separate layers of a filler such as an adhesive such that the hardness in the cured state increases approaching the bottom surface side of the fixing plate (for example, refer to Japanese Patent No. 5136752).

However, in the liquid ejecting head described above, since the hardness of the filler which fills the gap between the side surfaces of the head units and the side surfaces of the fixing plate is reduced the further the filler is from the bottom surface of the fixing plate, for example, when a recording medium collides with the side surfaces of the fixing plate due to a so-called jam in which a recording medium such as paper is jammed, the side surfaces warp easily. In particular, since a recording medium which is formed of a synthetic resin such as vinyl chloride has high rigidity and does not easily rip in comparison to paper, the force which is applied to the side surfaces of the fixing plate when the recording medium collides with the side surfaces of the fixing plate is great. When the side surfaces of the fixing plate warp due to the external force, stress arises in the bottom surface of the fixing plate. As a result, there is a concern that the nozzle surface which is fixed to the bottom surface will be damaged.

SUMMARY

An advantage of some aspects of the invention is to provide a liquid ejecting head capable of suppressing the damage to the nozzle surface.

Application Example 1

According to this application example, there is provided a liquid ejecting head which includes a head unit configured to eject a liquid from a nozzle which is formed on a nozzle surface, and a fixing plate. The fixing plate includes a bottom surface and a first side surface. The bottom surface is fixed to the nozzle surface of each of a plurality of the head units which are provided to line up in a state in which a first gap is remained along a first direction parallel to the nozzle surface, and the first side surface extends to the head unit side from an edge of the bottom surface which is positioned closer to an outside in the first direction than the lined-up head units. The fixing plate includes a second gap which is formed between the first side surface and the head units which are positioned at ends in the first direction among the head units. The liquid ejecting head also includes a first filler which fills at least a portion of the first gap, and a second filler which fills at least a portion of the second gap. The second filler fills the second gap at a position which is distanced further from the bottom surface than the first filler in a direction which is perpendicular to the bottom surface, and a hardness of the second filler is higher than a hardness of the first filler.

According to the invention, since the second gap is filled with the second filler which has a higher hardness in a position which is distanced further from the bottom surface, even if an external force is applied to the first side surface due to a collision or the like of the recording medium, it is possible to suppress the warping of the first side surface. Accordingly, it is possible to suppress the stress on the bottom surface which arises due to the warping of the first side surface, and it is possible to suppress the damage to the nozzle surfaces which are fixed to the bottom surface. Meanwhile, since the first gap is filled with the first filler which has a lower hardness, it is possible to suppress the deformation of the fixing plate and the head unit which is caused by the contraction force which arises when the liquid-state filler in the first gap cures to form the first filler. As a result, it is possible to suppress the misalignment of the head unit and the damage to the nozzle surfaces.

Application Example 2

In the liquid ejecting head according to application example 1, a maximum interval between the head unit and the first side surface in the second gap is narrower than a maximum interval between adjacent head units in the first gap.

In this case, since the second gap becomes narrower, it is possible to fill the second gap to a position which is distanced further from the bottom surface with the liquid-state filler due to the capillary force which arises when the second gap is filled with the second filler. Since the second gap is narrow, it is possible to reduce the warp amount even if the first side surface warps to the head unit side.

Application Example 3

In the liquid ejecting head according to application example 1 or 2, the fixing plate includes a second side surface which extends to the head unit side in a state in which a third gap is formed in a space from an edge of the bottom surface, which is positioned closer to an outside than the head unit in a second direction which is parallel with the nozzle surface and orthogonal to the first direction, to the head units, and a maximum interval between the head units and the second side surface in the third gap is narrower than a maximum interval between the head units and the first side surface in the second gap.

In this case, since the third gap is further narrowed, it is possible to reduce the size of the fixing plate in the second direction. Accordingly, it is possible to suppress the collision of the recording medium into the fixing plate, and thus, it is possible to suppress the damage to the nozzle surfaces.

Application Example 4

In the liquid ejecting head according to application examples 1 to 3, among the lined-up head units, at least the head units which are positioned at ends in the first direction include at least two adjacent ribs protruding toward the second gap to leave an interval in a second direction which is parallel with the nozzle surface and orthogonal to the first direction.

In this case, it is possible to define the filling range of the second adhesive in the second direction using the space between the ribs. Accordingly, when the second gap is filled with the second filler, it is possible to suppress the spilling over of the liquid-state filler to the outside of the filling range. As a result, it is possible to suppress the filling of the outside of the second gap with the second filler which has a high hardness and in which the contraction force which arises when curing is great, and it is possible to suppress the deformation of the fixing plate and the head unit which arises from the contraction force of the filler.

Application Example 5

In the liquid ejecting head according to application example 4, the head unit includes at least two ribs protruding outward from each side in the first direction to leave an interval in the second direction, and the ribs protruding from one side are formed to be shifted in the second direction in relation to the ribs protruding from other side.

In this case, it is possible to prevent the ribs of the adjacent head units from interfering with each other when the head units are lined up in the first direction. Accordingly, it is possible to reduce the size of the gap between the head units, and thus, it is possible to miniaturize the liquid ejecting head.

Application Example 6

According to this application example, there is provided a liquid ejecting head which includes a head unit which ejects a liquid from a nozzle which is formed on a nozzle surface, and a fixing plate. The fixing plate includes a bottom surface which is fixed onto the nozzle surface of each of a plurality of the head units which are provided to line up in a state in which a first gap is formed along a first direction parallel to the nozzle surface, a first side surface which extends from an edge of the bottom surface which is positioned closer to an outside in the first direction than the lined-up head units to the head unit side, and a second side surface which extends to the head unit side from an edge of the bottom surface which is positioned closer to an outside in a second direction which is parallel with the nozzle surface of the lined-up head units and orthogonal to the first direction. The fixing plate includes a second gap which is formed between the first side surface and the head units which are positioned at ends in the first direction among the head units, and is provided with a third gap between the second side surface and the head units. The liquid ejecting head also includes a first filler which fills at least a portion of the first gap, and a second filler which fills at least a portion of the second gap. A maximum interval between the head units and the second side surface in the third gap is narrower than a maximum interval between the head units and the first side surface in the second gap, and a hardness of the second filler is higher than a hardness of the first filler.

In this case, since the second gap is filled with the second filler which has a higher hardness, even if an external force is applied to the first side surface due to a collision or the like of the recording medium, it is possible to suppress the warping of the first side surface. Accordingly, it is possible to suppress the stress on the bottom surface which arises due to the warping of the first side surface, and it is possible to suppress the damage to the nozzle surfaces which are fixed to the bottom surface. Meanwhile, since the first gap is filled with the first filler which has a lower hardness, it is possible to suppress the deformation of the fixing plate and the head unit which is caused by the contraction force which arises when the liquid-state filler in the first gap cures to form the first filler. As a result, it is possible to suppress the misalignment of the head unit and the damage to the nozzle surfaces. Since the third gap is further narrowed, it is possible to reduce the size of the fixing plate in the second direction. Accordingly, it is possible to suppress the collision of the recording medium into the fixing plate, and thus, it is possible to suppress the damage to the nozzle surfaces.

Application Example 7

In the liquid ejecting head according to application example 6, among the lined-up head units, at least the head units which are positioned at ends in the first direction include at least two adjacent ribs protruding toward the second gap to leave an interval in the second direction.

In this case, it is possible to define the filling range of the second adhesive in the second direction using the space between the ribs. Accordingly, when the second gap is filled with the second filler, it is possible to suppress the spilling over of the liquid-state filler to the outside of the filling range. As a result, it is possible to suppress the filling of the outside of the second gap with the second filler which has a high hardness and in which the contraction force which arises when curing is great, and it is possible to suppress the deformation of the fixing plate and the head unit which arises from the contraction force of the filler.

Application Example 8

In the liquid ejecting head according to application example 7, the head unit includes at least two ribs protruding outward from each side in the first direction to leave an interval in the second direction, and the ribs protruding from one side are formed to be shifted in the second direction in relation to the ribs protruding from other side.

In this case, it is possible to prevent the ribs of the adjacent head units from interfering with each other when the head units are lined up in the first direction. Accordingly, it is possible to reduce the size of the gap between the head units, and thus, it is possible to miniaturize the liquid ejecting head.

Application Example 9

In the liquid ejecting head according to application examples 1 to 8, a space between the second filler and the bottom surface in the second gap is filled with the first filler.

In this case, since the second gap is filled with the first filler which has a lower hardness closer to the bottom surface side than the second filler, it is possible to further suppress the deformation of the fixing plate and the head unit which is caused by the contraction force which arises when the liquid-state filler in the second gap cures. As a result, it is possible to further suppress the misalignment of the head unit and the damage to the nozzle surface. Meanwhile, since the second gap is filled with the second filler which has a higher hardness in a position which is distanced further from the bottom surface than the first filler, even if an external force is applied to the first side surface due to a collision or the like of the recording medium, it is possible to suppress the warping of the first side surface. Accordingly, it is possible to suppress the stress on the bottom surface which arises due to the warping of the first side surface, and it is possible to suppress the damage to the nozzle surfaces which are fixed to the bottom surface.

Application Example 10

In the liquid ejecting head according to application example 9, the first filler is injected from the second gap to fill the first gap and the second gap.

In this case, since the liquid-state filler which forms the first filler is injected from the second gap and is allowed to flow to the first gap, it is possible to reduce the number of injection positions of the filler. As a result, the filling work of the first filler is simplified.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of embodiments of the invention with reference to the attached drawings. Note that, in the embodiments described hereinafter, there are various limits as favorable embodiments of the invention; however, the scope of the invention is not limited thereto as long as there is no wording particularly limiting the invention in the description hereinafter. Hereinafter, an ink jet printer (hereinafter simply referred to as a printer 1) with an ink jet recording head (hereinafter simply referred to as a recording head 3), which is a type of the liquid ejecting head, mounted thereon will be described as an example of the liquid ejecting apparatus of the invention.

Figure 1:
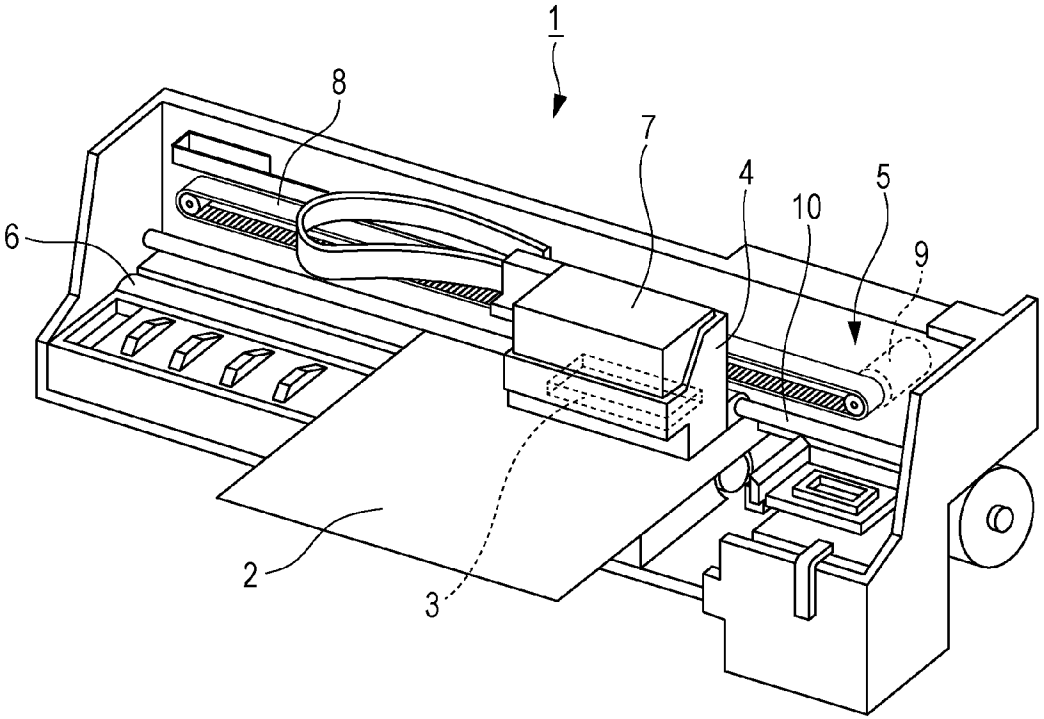
FIG. 1 is a schematic diagram illustrating the configuration of a printer.

First, description will be given of the configuration of the printer 1 in the present embodiment, with reference to FIG. 1. The printer 1 is an apparatus which performs recording of an image or the like by ejecting a liquid-state ink onto the surface of a recording medium 2 such as recording paper or a film formed of a synthetic resin. The printer 1 is provided with a recording head 3, a carriage 4, and a carriage movement mechanism 5. The recording head 3 is attached to the carriage 4, and the carriage movement mechanism 5 causes the carriage 4 to move in the main scanning direction. The printer 1 is provided with a platen roller 6, for example, as a mechanism which transfers the recording medium 2 in the sub-scanning direction. Besides the platen roller 6, a drum or the like may be used as the transfer mechanism. Here, the ink is a type of the liquid in the invention, and is stored in ink cartridges 7 which serve as a liquid supply source. The ink cartridges 7 are detachably mounted to the recording head 3. Note that, a configuration may be adopted in which the ink cartridges 7 are disposed on a main body side of the printer 1, and the ink is supplied from the ink cartridges 7 to the recording head 3 through ink supply tubes.

The carriage movement mechanism 5 is provided with a timing belt 8. The timing belt 8 is driven by a pulse motor 9 such as a DC motor. Therefore, when the pulse motor 9 is driven, the carriage 4 is guided by a guide rod 10 which is provided to bridge across the printer 1 and moves reciprocally in the main scanning direction (this corresponds to the first direction in the invention).

Figure 2:
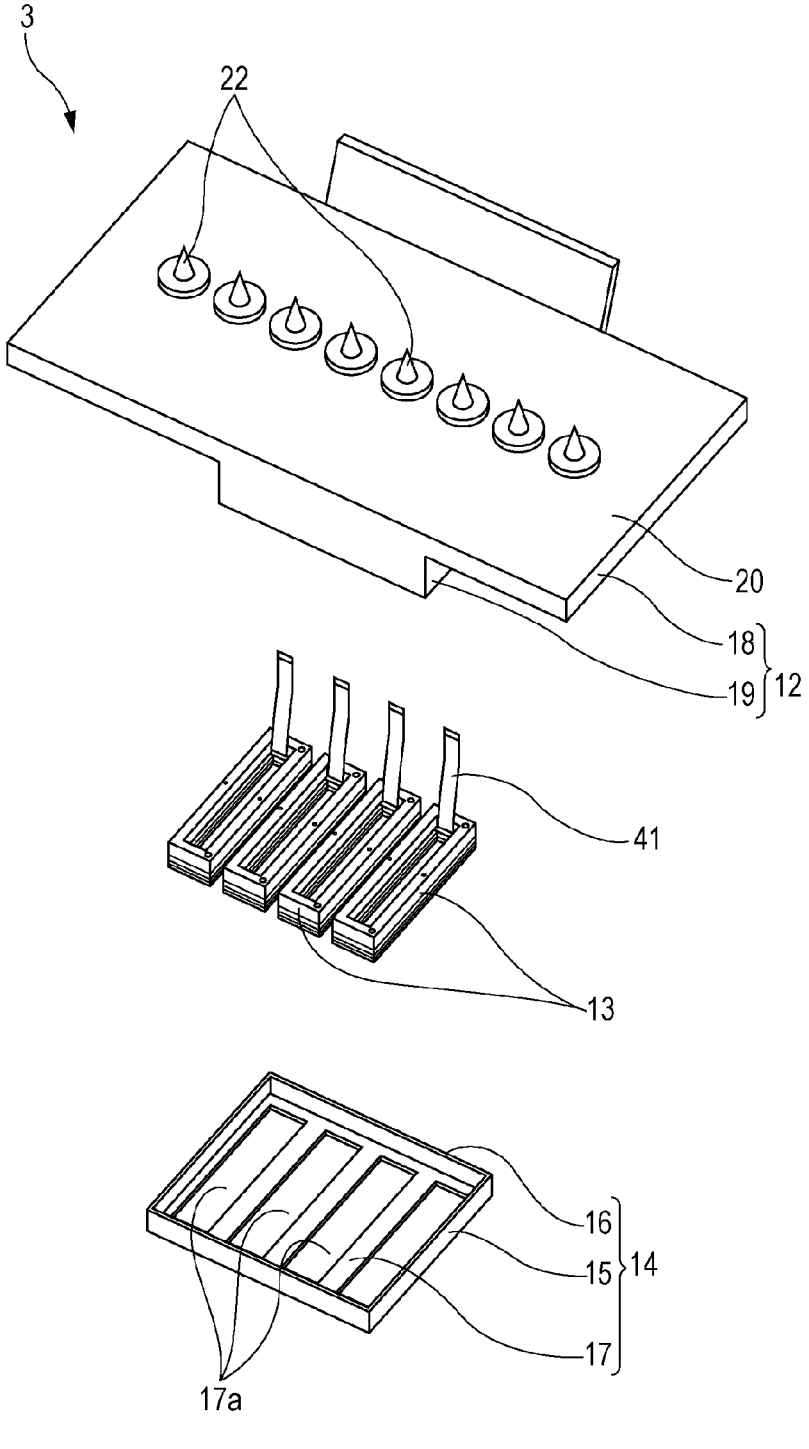
FIG. 2 is an exploded perspective diagram of a recording head.
Figure 3:
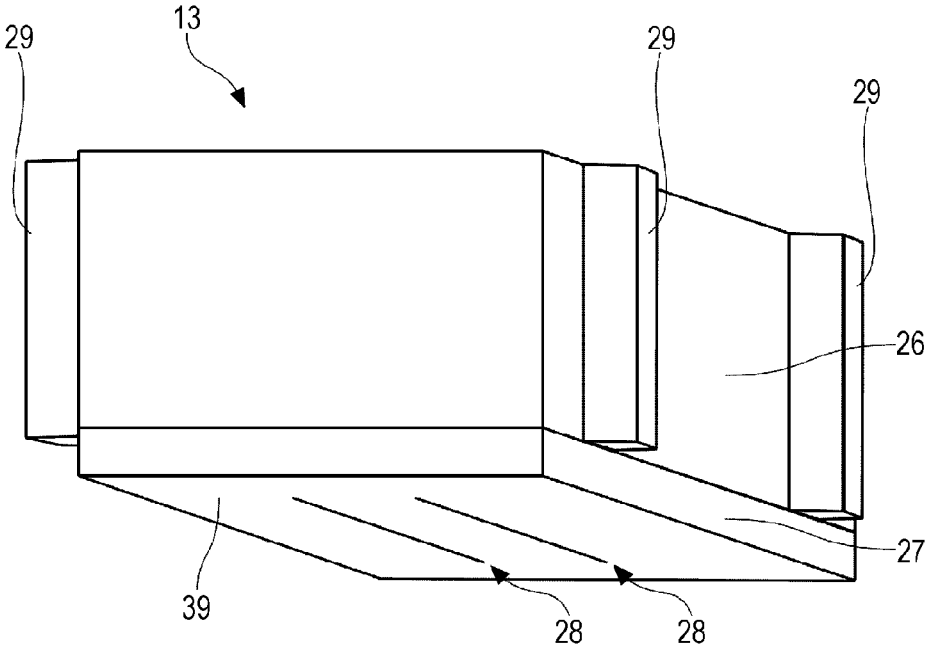
FIG. 3 is a perspective diagram of a head unit.
Figure 4:
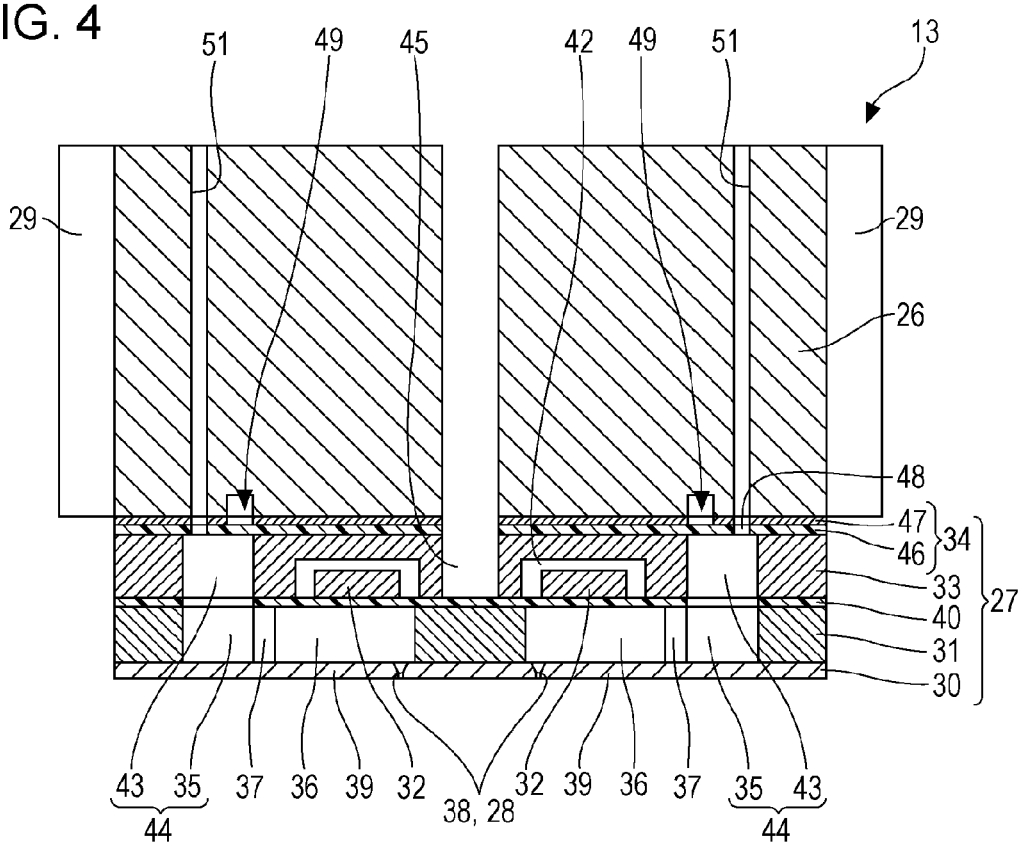
FIG. 4 is a cross sectional diagram of the head unit.
Figure 5:
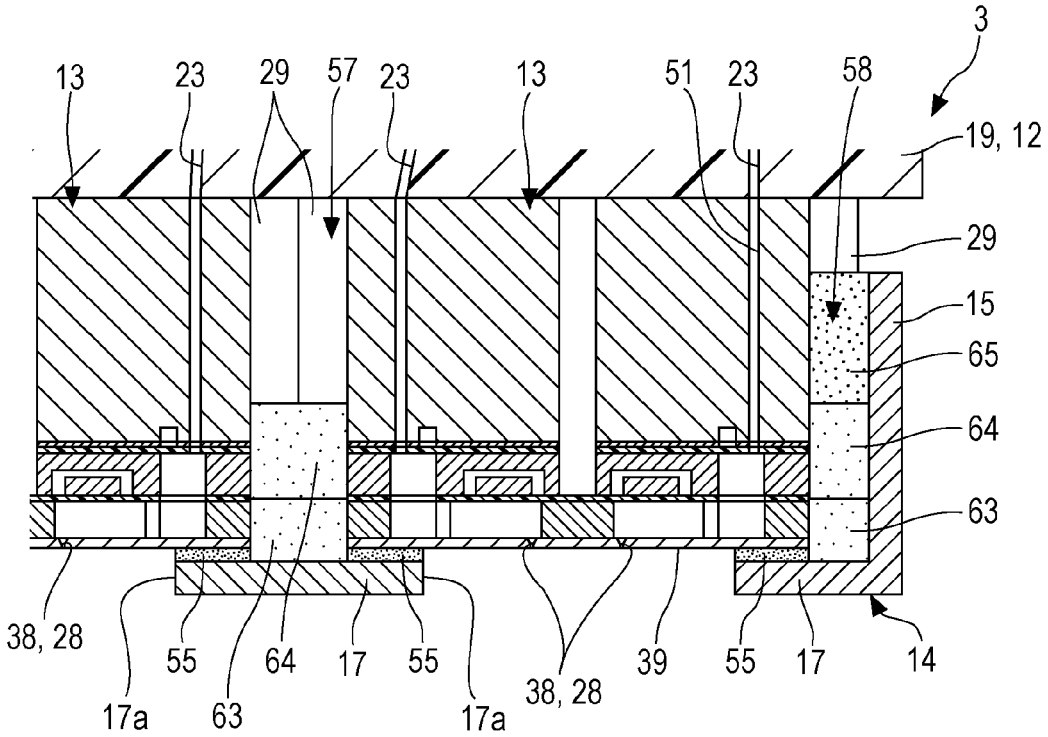
FIG. 5 is a cross sectional diagram of the main parts of the recording head in a first embodiment.

FIG. 2 is an exploded perspective diagram illustrating the configuration of the recording head 3. FIG. 3 is a perspective diagram of a head unit 13. FIG. 4 is a cross sectional diagram of the head unit 13. FIG. 5 is a cross sectional diagram of the main parts of the recording head 3. The recording head 3 in the present embodiment is formed by laminating a holder 12, the plurality of head units 13, a fixing plate 14, and the like.

The holder 12 is a member formed of a synthetic resin and is provided with a needle holder 18 and a unit holder 19. The needle holder 18 includes a cartridge mounting unit 20 into which each of the ink cartridges is mounted 7. In the cartridge mounting unit 20, corresponding to each color of the ink of the ink cartridges 7, a total of eight introduction needles 22 are provided to stand in a line along the main scanning direction. The introduction needles 22 are hollow needle shaped members which are inserted into the ink cartridges 7 and introduce the ink which is stored in the ink cartridges 7 to holder flow paths 23 (refer to FIG. 5) through needle flow paths (not shown). Note that, the configuration in which the ink is introduced from the ink cartridges 7 into the recording head 3 is not limited to the introduction needles 22, and it is possible to adopt a configuration in which, for example, porous members capable of absorbing the ink are provided on the supply side and the receiving side of the ink, and the ink is transferred by bringing the porous members into contact with each other.

The unit holder 19 is a member to which the plurality of head units 13 is connected from below. In the present embodiment, four of the head units 13 are provided in parallel along the main scanning direction, which is a direction which is parallel with the nozzle surface 39, in a state in which a first gap 57 (refer to FIGS. 5 and 6) is formed between each of the head units 13. The head units 13 are aligned with each other by being adhesively fixed to the fixing plate 14. Note that, the fixing between the head unit 13 and the fixing plate 14 will be described later. The number of the head units 13 is not limited to four, as long as there is a plurality thereof.

As illustrated in FIG. 5, the holder flow paths 23 which supply the ink which is introduced from the introduction needles 22 to the head unit 13 side are formed on the inner portion of the holder 12. The upstream side of the holder flow paths 23 communicate with the needle flow paths of the introduction needles 22, and the downstream side of the holder flow paths 23 communicate with ink introduction paths 51 of the head unit 13. In the present embodiment, eight of the holder flow paths 23 are formed to correspond to eight of the introduction needles 22.

As illustrated in FIG. 3, the head unit 13 is provided with a head case 26, and a head chip 27 which is connected to the head case 26 from below. Note that, with regard to the head case 26 in the present embodiment, since the configuration corresponding to one nozzle row 28 is horizontally symmetrical with the configuration corresponding to another nozzle row 28, the following description will focus on the configuration corresponding to one nozzle row 28. For convenience, the direction in which the members are laminated will be described as the vertical direction.

The head case 26 is a hollow box-shaped member in which an insertion space 50 is formed, and a flexible cable 41 (refer to FIG. 2) is inserted through the insertion space 50. The ink introduction path 51 is formed in the inner portion of the head case 26. The ink introduction path 51 is a flow path for supplying the ink from the holder 12 side to a reservoir 44, the top end thereof communicates with the holder flow path 23, and the bottom end thereof communicates with an ink introduction port 48 (described later). A sealed space of a magnitude which does not impede the flexible deformation of a sealing film 46 is formed in a portion of the bottom surface of the head case 26 which faces a sealing portion 49 (described later).

A total of four ribs 29 are formed on the surfaces of both sides of the head case 26 in the main scanning direction. The ribs 29 protrude outward from both sides, and two are formed on each side. The ribs 29 of the present embodiment extend in a direction perpendicular to the nozzle surface 39 from the bottom end toward the top end in the height direction of the head case 26. The ribs 29 are disposed to leave a predetermined interval therebetween in the sub-scanning direction (this corresponds to a second direction in the invention) or the nozzle row direction. The sub-scanning direction is a direction which is parallel to the nozzle surface 39 and is orthogonal to the main scanning direction. In plan view, the ribs 29 which protrude from the side surface of one side are formed shifted in the sub-scanning direction alternately from the ribs 29 which protrude from the side surface of another side (refer to FIG. 6).

As illustrated in FIG. 4, the head chip 27 is formed by laminating a nozzle plate 30, a flow path substrate 31, a piezoelectric element 32, a protective substrate 33, a compliance substrate 34, and the like.

The flow path substrate 31 is formed of a silicon single crystal substrate or the like which is long along the nozzle row direction, and a thin, long communication portions 35 are formed along the longitudinal direction. A plurality of pressure chambers 36 are provided closer to the inside than the communication portions 35 so as to be parallel with the nozzle row direction. Each pressure chamber 36 communicates with a communication portion 35 via an ink supply path 37 which is formed to be narrower than the pressure chamber 36.

The nozzle plate 30 is fixed to the bottom surface of the flow path substrate 31, that is, the surface of the opposite side from the piezoelectric element 32 side via an adhesive, a hot melt film, or the like. The nozzle plate 30 is formed of a silicon single crystal substrate or the like which is thinner than the flow path substrate 31, and a plurality of nozzles 38 which communicate with the respective pressure chambers 36 on the opposite side from the ink supply path 37 are provided to puncture the nozzle plate 30 along the sub-scanning direction. The nozzles 38 are provided to line up at a 360 dpi pitch, for example, and form the nozzle row 28. Note that, the bottom surface of the nozzle plate 30 corresponds to the nozzle surface 39 in the invention.

An elastic film 40 is laminated on the top surface of the flow path substrate 31, that is, the surface of the opposite side from the nozzle plate 30 side. Corresponding to the pressure chambers 36, a plurality of the piezoelectric elements 32 are formed on the elastic film 40. For example, the piezoelectric elements 32 are formed by sequentially laminating a bottom electrode film, a piezoelectric layer, and a top electrode film. One end of a lead electrode (not shown) which is conductively joined to the top electrode film is connected to an end portion of one side (the side on which a disposition space 45 (described later) is formed) of the piezoelectric element 32. The other end of the lead electrode extends to the disposition space 45 side on an insulating film, and is electrically connected to one end of the flexible cable 41 (refer to FIG. 2). Note that, the other end of the flexible cable 41 is connected to a control unit (not shown).

The protective substrate 33 is bonded onto the elastic film 40 and includes a piezoelectric element holding space 42 in a region which faces the piezoelectric element 32. The piezoelectric element holding space 42 forms a space of a magnitude which does not impede the displacement of the piezoelectric element 32. A long ink chamber 43 which penetrates the thickness direction is provided in a position which faces the communication portion 35 in the protective substrate 33. The disposition space 45 for connecting the flexible cable 41 to the lead electrode is formed in the protective substrate 33. The ink chamber 43 communicates with the communication portion 35 and forms the reservoir 44 which supplies the ink to the pressure chamber 36.

The compliance substrate 34, which is formed by laminating the flexible sealing film 46 and a fixing substrate 47 formed of a hard member such as a metal, is bonded onto the protective substrate 33. The ink introduction port 48 which introduces the ink to the reservoir 44 penetrate the compliance substrate 34 in the thickness direction at a position corresponding to the ink introduction path 51. Of the regions of the compliance substrate 34 facing the reservoir 44, the region outside of the ink introduction port 48 is a sealing portion 49 which is formed of only the sealing film 46 at which the fixing substrate 47 is removed. Accordingly, the reservoir 44 is sealed by the flexible sealing film 46 and can obtain compliance.

The ink from the ink cartridges 7 is taken into the pressure chambers 36 via the introduction needles 22, the holder flow paths 23, the ink introduction paths 51, the ink introduction ports 48, the reservoirs 44, and the ink supply paths 37. The head unit 13 causes changes in pressure of the ink in the pressure chambers 36 by driving the piezoelectric elements 32, and ejects the ink from the nozzles 38 which communicate with the pressure chambers 36 by using the changes in pressure.

Figure 6A:
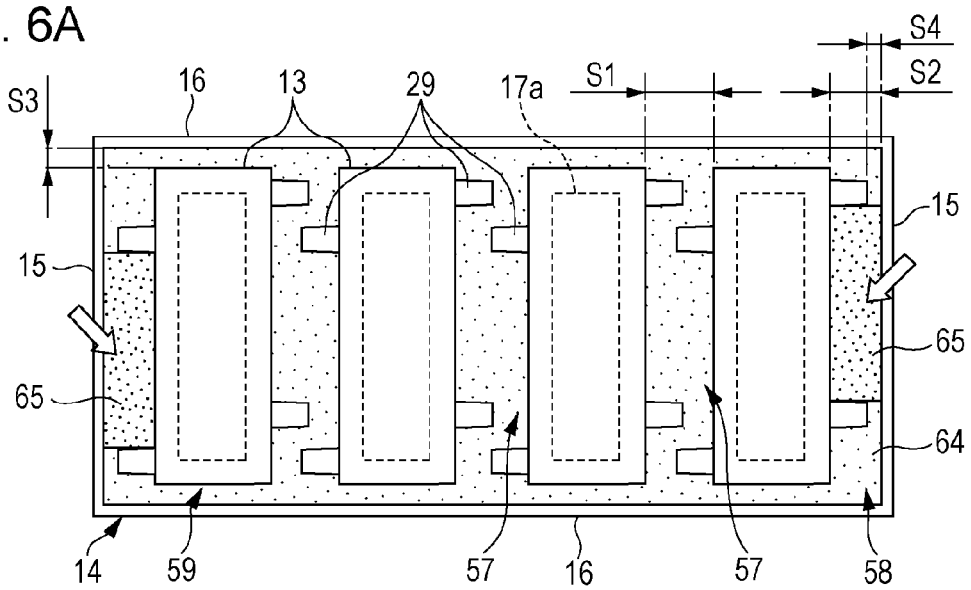
FIGS. 6A to 6C are schematic diagrams illustrating the formation positions of each outer circumferential mold in the first embodiment.
Figure 6B:
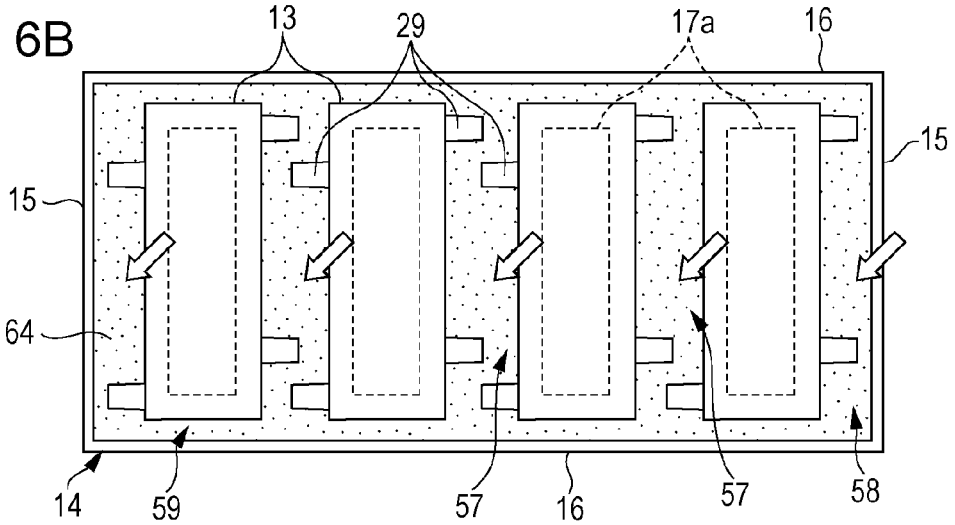
Figure 6C:
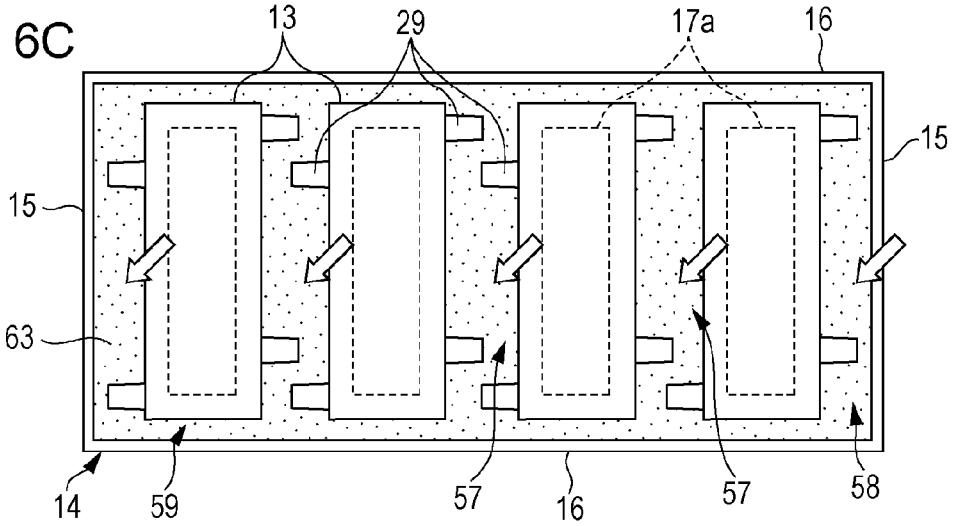

Next, description will be given of an outer circumferential mold which fills the outer circumferences of the fixing plate 14 and each of the head units 13. FIGS. 6A to 6C are plan views of the fixing plate 14 as viewed from above. FIG. 6A is a schematic diagram illustrating the filling positions of a third outer circumferential mold 65 (this corresponds to a second filler in the invention). FIG. 6B is a schematic diagram illustrating the filling positions of a second outer circumferential mold 64 (this corresponds to a first filler in the invention). FIG. 6C is a schematic diagram illustrating the filling positions of a first outer circumferential mold 63. Note that, the arrows in FIG. 6A represent the filling positions of the third outer circumferential mold 65 in a liquid state before curing, the arrows in FIG. 6B represent the filling positions of the second outer circumferential mold 64 in a liquid state before curing, and the arrows in FIG. 6C represent the filling positions of the first outer circumferential mold 63 in a liquid state before curing.

The fixing plate 14 is formed of a metal such as stainless steel (SUS), and, as illustrated in FIGS. 2 and 5, is provided with a bottom surface 17, a first side surface 15, and a second side surface 16. The bottom surface 17 is fixed to the nozzle surfaces 39 of each of the head units 13, the first side surface 15 extends from an edge of the bottom surface 17 which is positioned closer to the outside in the main scanning direction than the lined-up head units 13 to the head unit 13 side, and the second side surface 16 extends from the edge of the bottom surface 17 which is positioned on the outside in the sub-scanning direction to the head unit 13 side. In other words, the first side surface 15 and the second side surface 16 are formed to surround the outer circumference of the lined-up head units 13 from the sides of the side surfaces. Four opening portions 17*a* which expose the nozzles 38 of the head units 13 are provided in the bottom surface 17 to line up along the main scanning direction to correspond to the four lined-up head units 13. In the present embodiment, two of the nozzle rows 28 are exposed on one of the opening portions 17*a*. Each of the head units 13 is fixed to a region other than the opening portions 17*a* of the bottom surface 17 in an aligned state using an adhesive 55. Note that, an adhesive which has a comparatively high hardness when cured, for example, an epoxy-based resin is used as the adhesive 55 such that the position of the head unit 13 does not shift.

The first side surface 15 of the present embodiment stands substantially vertically from the bottom surface 17 along the side surfaces of the head units 13 which are positioned at the ends on both sides in the main scanning direction among the head units 13. The second side surface 16 of the present embodiment stands substantially vertically from the bottom surface 17 along the side surfaces of both sides in the sub-scanning direction of the head units 13. As illustrated in FIG. 5, the first side surface 15 and the second side surface 16 extend to a position above the head chip 27 and below the unit holder 19. As illustrated in FIGS. 6A to 6C, a second gap 58 is provided between the first side surface 15 and the side surfaces of the head units 13 which are positioned at the ends on both sides in the main scanning direction among the head units 13, one at each end. A third gap 59 is provided between the second side surface 16 and the side surfaces of both sides in the sub-scanning direction of the head units 13.

Here, a maximum interval S2 between the head unit 13 and the first side surface 15 in the second gap 58 is narrower than a maximum interval S1 between adjacent head units 13 in the first gap 57. A maximum interval S3 between the head unit 13 and the second side surface 16 in the third gap 59 is narrower than the maximum interval S2 between the head unit 13 and the first side surface 15 in the first gap 57. In other words, the maximum intervals S1, S2, and S3 of the respective gaps 57, 58, and 59 satisfy the following expression (1).

$$S1>S2>S3 \quad (1)$$

By rendering the maximum interval S1 of the first gap 57 wide, a liquid-state mold material does not easily creep upward due to the capillary force before curing when filling the outer circumferential mold, and the mold first gap 57 being filled with more mold material than intended is suppressed. As a result, it is possible to reduce the contraction stress which acts on the side surfaces of the head units 13 and arises when the liquid-state mold material cures. Meanwhile, since the maximum interval S3 of the third gap 59 is reduced, the liquid-state mold material easily creeps upward due to the capillary force before curing when filling the outer circumferential mold. Therefore, the contraction stress which acts on the side surfaces of the head units 13 increases; however, since the third gap 59 is the gap is at both sides in the longitudinal direction, that is, the nozzle row direction of the head units 13, the head units 13 do not deform easily. In other words, since the head units 13 are disposed like beams in relation to the fixing plate 14, the influence of the contraction stress which is generated by the outer circumferential mold which is filled on the head units 13 is smaller in the third gap 59 than the first gap 57. Therefore, it is possible to reduce the width of the maximum interval S3 of the third gap 59 as much as possible.

Note that, it is desirable that the maximum interval S1 between the adjacent head units 13 in the first gap 57 is approximately twice the maximum interval S2 between the head units 13 and the first side surface 15 in the second gap 58. Note that, the maximum interval S1 between the adjacent head units 13 in the first gap 57 is set to 2 mm to 3 mm, and the maximum interval S2 between the head units 13 and the first side surface 15 in the second gap 58 is set to 1 mm to 1.5 mm.

The gaps 58 and 59 between the side surfaces 15 and 16 of the fixing plate 14 and the head units 13, and the first gap 57 between the head units 13 have sufficient intervals to be capable of adjusting the alignment to correct a misalignment of the nozzle rows 28 arising from manufacturing error or the like by translating or rotating the head units 13 when fixing the head units 13 to the bottom surface 17 of the fixing plate 14. In other words, the gaps 57, 58, and 59 have intervals which are sufficient that the head unit 13 does not abut the adjacent head unit 13 or the side surface of the fixing plate 14, even if the nozzle surface 39 of the head unit 13 abuts the bottom surface 17 of the fixing plate 14 and the head unit 13 is translated or rotated by the amount of manufacturing error in a planar direction parallel to the bottom surface 17. For example, when the length of the nozzle row 28 is approximately 1 inch (25.4 mm), if the manufacturing error is taken into consideration, it is preferable to set a minimum interval S4 between the head unit 13 and the first side surface 15 in the second gap 58 to 0.2 mm to 0.3 mm.

As illustrated in FIGS. 5 to 6C, at least a portion of the first gap 57 is filled with the second outer circumferential mold 64, and at least a portion of the second gap 58 is filled with the third outer circumferential mold 65. Note that, in the present embodiment, as illustrated in FIGS. 5 and 6C, the gaps are filled with the first outer circumferential mold 63 in addition to the second outer circumferential mold 64 and the third outer circumferential mold 65. The first outer circumferential mold 63 is an outer circumferential mold which has a comparatively high hardness when cured, and the lowest layer portion of each of the gaps 57, 58, and 59 is filled with the first outer circumferential mold 63. Specifically, an entire region which is below the head case 26 and is distanced from the head unit 13 of the bottom surface 17 of the fixing plate 14 (in other words, a region which is distanced from a region between the bottom surface 17 and the nozzle surface 39 which is bonded by the adhesive 55) is filled with the first outer circumferential mold 63. Accordingly, it is possible to strongly fix the head unit 13 and the fixing plate 14 to each other after the positioning.

As illustrated in FIGS. 5 and 6B, above the first outer circumferential mold 63, the gaps 57, 58, and 59 are filled with the second outer circumferential mold 64 which has a comparatively low hardness when cured. Specifically, the second outer circumferential mold 64 is laminated onto the first outer circumferential mold 63 across the head chip 27 and the head case 26. The gaps 57, 58, and 59 are filled with the second outer circumferential mold 64 to a position which is lower than the height of the top end of the first side surface 15. As illustrated in FIGS. 5 and 6A, the spaces which are above the second outer circumferential mold 64 in the second gap 58 and are between the two adjacent ribs 29 which protrude from the head units 13, which are positioned on each side in the main scanning direction among the lined-up head units 13, toward the second gap 58 are filled with the third outer circumferential mold 65 which has a comparatively high hardness when cured. Above the second outer circumferential mold 64, the second gap 58 is filled with the third outer circumferential mold 65 to the same height as the top end of the first side surface 15. In other words, the second gap 58 is filled with the second outer circumferential mold 64 between the bottom surface 17 and the third outer circumferential mold 65. The second gap 58 is filled with the third outer circumferential mold 65 in a position which is distanced further from the bottom surface 17 in a direction which is perpendicular to the bottom surface 17, that is, in the height direction than the second outer circumferential mold 64 in the first gap 57.

Note that, for example, an epoxy-based adhesive is used as the mold material which is used in the first outer circumferential mold 63 and the third outer circumferential mold 65. For example, a silicon-based adhesive is used as the mold material which is used in the second outer circumferential mold 64. Additionally, any adhesive may be used as long as the hardness of the second outer circumferential mold 64 is lower than that of the first outer circumferential mold 63 and the third outer circumferential mold 65 when cured.

Next, description will be given of the filling method of the first outer circumferential mold 63, the second outer circumferential mold 64, and the third outer circumferential mold 65. First, the nozzle surfaces 39 of the head units 13 and the bottom surface 17 are adhered to each other using the adhesive 55 in a state in which the head units 13 are aligned in relation to the fixing plate 14. Note that, for example, using a camera or the like, the alignment of the fixing plate 14 and the head unit 13 is performed by viewing the relative positions of the nozzles 38 which are positioned on both ends of the nozzle rows 28 and an alignment mark which is provided in advance on the fixing plate 14 or on a jig which holds the fixing plate 14, an alignment mark which is displayed in an image which is captured by a camera, or the like, and aligning the positions of the nozzles 38 and the alignment mark. In this state, the nozzle surfaces 39 of the head units 13 and the fixing plate 14 are fixed to each other via the adhesive 55. Next, as illustrated by the arrows of FIG. 6C, mold material dispenser needles (hereinafter simply referred to as needles) are inserted into the first gaps 57 and the second gaps 58, and a liquid-state mold material which forms the first outer circumferential mold 63 is injected. The injected liquid-state mold material also flows to the third gap 59 side, and the gaps 57, 58, and 59 are filled. The liquid-state mold material is left for a predetermined time until the mold material cures (or solidifies) to form the first outer circumferential mold 63.

As illustrated in FIG. 6B, if the first outer circumferential mold 63 is cured, needles are inserted into the first gaps 57 and the second gaps 58 in the same manner, and a liquid-state mold material which forms the second outer circumferential mold 64 is injected. The injected liquid-state mold material also flows to the third gap 59 side by passing beneath the ribs 29, and the gaps 57, 58, and 59 are filled. The liquid-state mold material is left for a predetermined time until the mold material cures (or solidifies) to form the second outer circumferential mold 64.

As illustrated in FIG. 6A, if the second outer circumferential mold 64 is cured, needles are inserted between the ribs 29 in the second gaps 58, and a liquid-state mold material which forms the third outer circumferential mold 65 is injected. Here, an interval S4 between the rib 29 of the head unit 13 and the first side surface 15 in the second gap 58 is set to be an interval from which the liquid-state mold material does not exceed the rib 29 and spill over to the third gap 59 side due to the capillary force. Accordingly, only the space between the ribs 29 in the second gap 58 is filled with the mold material which forms the third outer circumferential mold 65. In the present embodiment, above the second outer circumferential mold 64, the mold material which forms the third outer circumferential mold 65 is used to fill to the same position as the height of the first side surface 15 of the fixing plate 14. Finally, by leaving the liquid-state mold material for a predetermined time until the mold material cures (or solidifies) to form the third outer circumferential mold 65, it is possible to create the recording head 3 which is described above. Note that, when a UV curing adhesive is used for the outer circumferential molds, the liquid state mold material is cured by being irradiated with UV.

In this manner, since the second gap 58 is filled with the third outer circumferential mold 65 which has a higher hardness in a position which is distanced further from the bottom surface 17 than the second outer circumferential mold 64 which has a lower hardness, even if an external force is applied to the first side surface 15 due to a collision or the like of the recording medium 2, it is possible to suppress the warping of the first side surface 15. In other words, it is possible to suppress the moment which is applied to the fixing plate 14. Accordingly, it is possible to suppress the stress on the bottom surface 17 which arises due to the warping of the first side surface 15, and it is possible to suppress the damage to the nozzle surfaces 39 which are fixed to the bottom surface 17. Meanwhile, since the first gap 57 is filled with the second outer circumferential mold 64 which has a lower hardness without being filled with the third outer circumferential mold 65 which has a higher hardness, it is possible to suppress the deformation of the fixing plate 14 and the head unit 13 which is caused by the contraction force which arises when the liquid-state mold material in the first gap 57 cures to form the second outer circumferential mold 64. As a result, it is possible to suppress the misalignment of the head unit 13 and the damage to the nozzle surface 39. In the present embodiment, since the second gap 58 is filled with the second outer circumferential mold 64 between the third outer circumferential mold 65 and the bottom surface 17, it is possible to further suppress the deformation of the fixing plate 14 and the head unit 13 which is caused by the contraction force which arises when the liquid-state mold material in the second gap 58 cures. As a result, it is possible to further suppress the misalignment of the head unit 13 and the damage to the nozzle surface 39.

Since the maximum interval S2 of the second gap is narrower than the maximum interval S1 of the first gap 57, it is possible to fill the second gap 58 to a position which is distanced further from the bottom surface 17 with the liquid-state mold material which forms the third outer circumferential mold 65 due to the capillary force which arises when the second gap 58 is filled with the third outer circumferential mold 65. Since the second gap 58 is narrow, it is possible to reduce the warp amount even if the first side surface 15 warps to the head unit 13 side. Since the maximum interval S3 of the third gap 59 is narrower than the maximum interval S2 of the second gap 58, it is possible to reduce the size of the fixing plate 14 in the sub-scanning direction. Accordingly, it is possible to suppress the collision of the recording medium 2 into the fixing plate 14, and thus, it is possible to suppress the damage to the nozzle surfaces 39.

Since the head unit 13 includes at least two adjacent ribs 29 which protrude toward the second gap 58 with an interval between the ribs 29 in the sub-scanning direction, it is possible to define the filling range in the sub-scanning direction of the third outer circumferential mold 65 using the space between the ribs 29. Accordingly, when the second gap 58 is filled with the third outer circumferential mold 65, it is possible to suppress the spilling over of the liquid-state mold material to the outside of the filling range. As a result, it is possible to suppress the filling of the outside of the second gap 58 with the third outer circumferential mold 65 which has a high hardness and in which the contraction force which arises when curing is great, and it is possible to suppress the deformation of the fixing plate 14 and the head unit 13 which arises from the contraction force of the mold material. Since the rib 29 which protrudes from one side is formed to be distanced from the rib 29 which protrudes from the other side in the sub-scanning direction, it is possible to prevent the ribs 29 of the adjacent head units 13 from interfering with each other when the head units 13 are lined up in the main scanning direction. Accordingly, it is possible to reduce the size of the first gap 57 between the head units 13, and thus, it is possible to miniaturize the recording head 3.

Note that, the injection positions of the second outer circumferential mold 64 are not limited to those described in the embodiment. For example, a configuration may be adopted in which the needles are inserted into only the second gap 58, the liquid-state mold material which forms the second outer circumferential mold 64 is injected from the second gap 58 and flows to the first gap 57 via the third gap 59. If such a configuration is adopted, since it is possible to reduce the number of injection positions of the liquid-state mold material, the filling task of the second outer circumferential mold 64 becomes simple.

Incidentally, in the first embodiment described above, the first gap 57, the second gap 58, and the third gap 59 are each filled with the second outer circumferential mold 64; however, the invention is not limited thereto. For example, in the second embodiment, only the first gap 57 is filled with the second outer circumferential mold 64.

Figure 7:
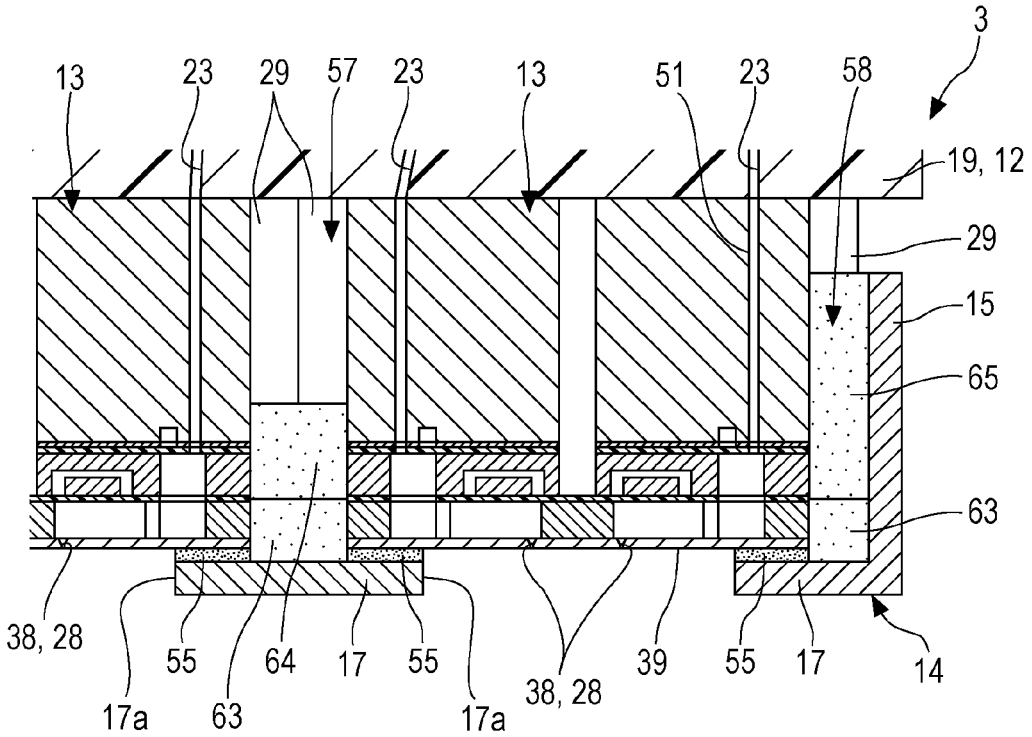
FIG. 7 is a cross sectional diagram of the main parts of the recording head in a second embodiment.
Figure 8A:
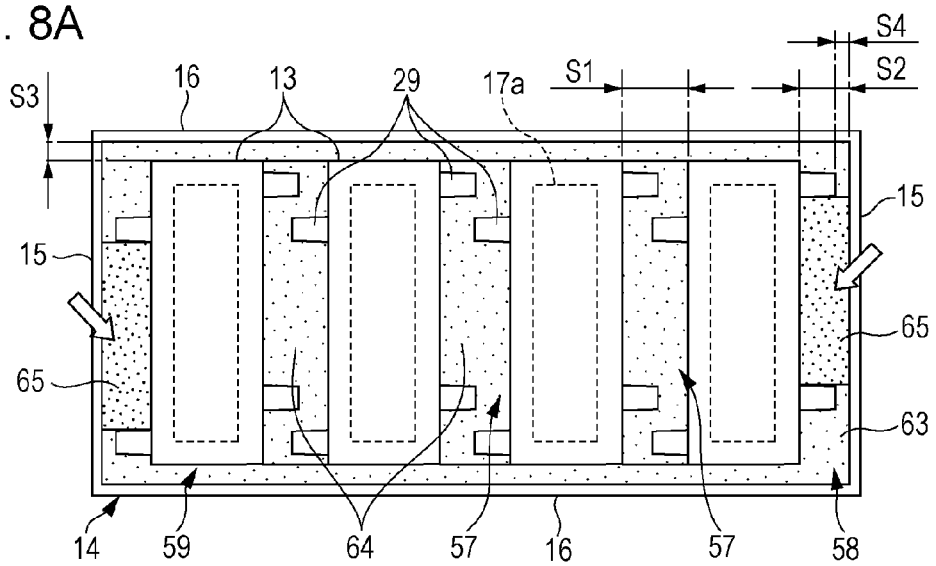
FIGS. 8A to 8C are schematic diagrams illustrating the formation positions of each outer circumferential mold in the second embodiment.
Figure 8B:
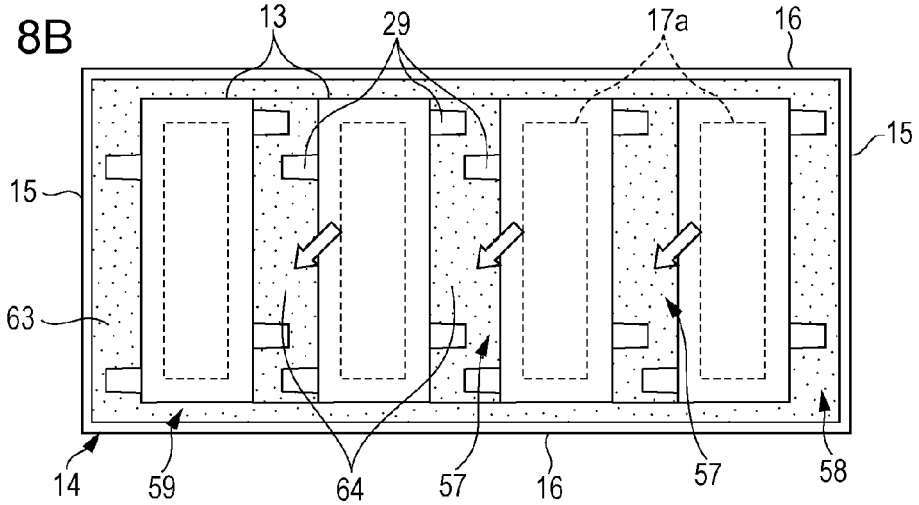
Figure 8C:
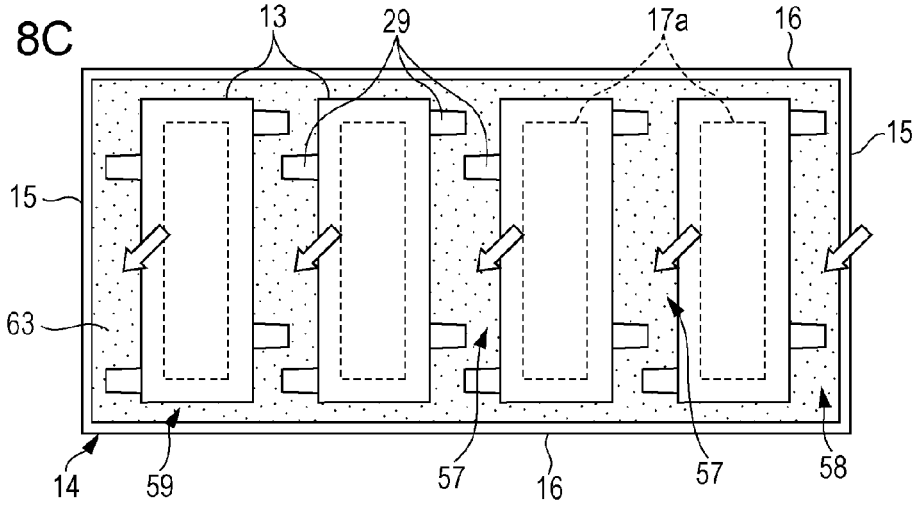

FIG. 7 is a cross sectional diagram of the main parts of the recording head 3 in the second embodiment. FIGS. 8A to 8C are plan views of the fixing plate 14 in the second embodiment as viewed from above. FIG. 8A is a schematic diagram illustrating the filling positions of the third outer circumferential mold 65. FIG. 8B is a schematic diagram illustrating the filling positions of the second outer circumferential mold 64. FIG. 8C is a schematic diagram illustrating the filling positions of the first outer circumferential mold 63. Note that, the arrows in FIG. 8A represent the filling positions of the third outer circumferential mold 65 in a liquid state before curing, the arrows in FIG. 8B represent the filling positions of the second outer circumferential mold 64 in a liquid state before curing, and the arrows in FIG. 8C represent the filling positions of the first outer circumferential mold 63 in a liquid state before curing.

As illustrated in FIGS. 7 and 8C, the first outer circumferential mold 63 which has a comparatively high hardness when cured, and the lowest layer portion of each of the gaps 57, 58, and 59 is filled with the first outer circumferential mold 63 in the same manner as in the first embodiment. As illustrated in FIGS. 7 and 8B, the second outer circumferential mold 64 which has a comparatively low hardness when cured is used to fill the first gap 57 above the first outer circumferential mold 63. In other words, while the first gap 57 is filled with the second outer circumferential mold 64 on top of the first outer circumferential mold 63, the second outer circumferential mold 64 is not laminated on the second gap 58 and the third gap 59. As illustrated in FIGS. 7 and 8A, the third outer circumferential mold 65 which has a comparatively high hardness when cured is laminated on the first outer circumferential mold 63 between the ribs 29 in the second gap 58. Here, since the maximum interval S2 of the second gap 58 is narrower than the maximum interval S1 of the first gap 57, the third outer circumferential mold 65 is used to fill to a higher position than the second outer circumferential mold 64 due to the capillary force which arises when filling. In the present embodiment, while the third outer circumferential mold 65 is used to fill to the same height as the height of the top end of the first side surface 15 of the fixing plate 14, the second outer circumferential mold 64 is used to fill to a position which is lower than the height of the top end of the first side surface 15 of the fixing plate 14. Note that, since the other configuration is the same as in the first embodiment described above, description thereof will be omitted.

Next, description will be given of the filling method of the first outer circumferential mold 63, the second outer circumferential mold 64, and the third outer circumferential mold 65 in the second embodiment. First, in the same manner as the first embodiment, the nozzle surfaces 39 of the head units 13 and the bottom surface 17 are adhered to each other using the adhesive 55 in a state in which the head units 13 are aligned in relation to the fixing plate 14. Next, as illustrated by the arrows of FIG. 8C the needles are inserted into the first gaps 57 and the second gaps 58, and a liquid-state mold material which forms the first outer circumferential mold 63 is injected. The injected liquid-state mold material also flows to the third gap 59 side, and the gaps 57, 58, and 59 are filled. The liquid-state mold material is left for a predetermined time until the mold material cures (or solidifies) to form the first outer circumferential mold 63.

As illustrated in FIG. 8B, if the first outer circumferential mold 63 is cured, needles are inserted into the first gaps 57, and a liquid-state mold material which forms the second outer circumferential mold 64 is injected. At this time, the amount of the liquid-state mold material to inject is reduced and the flowing to the third gap 59 side is suppressed. Note that, it is possible to suppress the flowing of the mold material to the third gap 59 side using the ribs 29 by filling the gap between the first outer circumferential mold 63 and the ribs 29 with more of the first outer circumferential mold 63 than in the first embodiment. By leaving the liquid-state mold material for a predetermined time until the mold material cures (or solidifies) to form the second outer circumferential mold 64, the second outer circumferential mold 64 is formed in the first gap 57.

As illustrated in FIG. 8A, if the second outer circumferential mold 64 is cured, needles are inserted between the ribs 29 in the second gaps 58, and a liquid-state mold material which forms the third outer circumferential mold 65 is injected. Even in the present embodiment, the interval S4 between the rib 29 of the head unit 13 and the first side surface 15 in the second gap 58 is set to a magnitude at which the liquid-state mold material does not exceed the rib 29 and spill over to the third gap 59 side due to the capillary force. Therefore, only the space between the ribs 29 in the second gap 58 is filled with the mold material which forms the third outer circumferential mold 65. Above the first outer circumferential mold 63, the mold material which forms the third outer circumferential mold 65 is used to fill to the same position as the height of the top end of the first side surface 15 of the fixing plate 14. Finally, by leaving the liquid-state mold material for a predetermined time until the mold material cures (or solidifies) to form the third outer circumferential mold 65, it is possible to create the recording head 3 in the second embodiment.

In this manner, in the present embodiment, since the second gap 58 is filled with the third outer circumferential mold 65 which has a higher hardness, even if an external force is applied to the first side surface 15 due to a collision or the like of the recording medium 2, it is possible to suppress the warping of the first side surface 15. Accordingly, it is possible to suppress the stress on the bottom surface 17 which arises due to the warping of the first side surface 15, and it is possible to suppress the damage to the nozzle surfaces 39 which are fixed to the bottom surface 17. Meanwhile, since the first gap 57 is filled with the second outer circumferential mold 64 which has a lower hardness, it is possible to suppress the deformation of the fixing plate 14 which is caused by the contraction force which arises when the liquid-state mold material in the first gap 57 cures to form the second outer circumferential mold 64. As a result, it is possible to suppress the misalignment of the head unit 13 and the damage to the nozzle surface 39. Since the third gap 59 is further narrowed, it is possible to reduce the size of the fixing plate 14 in the second direction. Accordingly, it is possible to suppress the collision of the recording medium 2 into the fixing plate 14, and thus, it is possible to suppress the damage to the nozzle surfaces 39.

In this manner, since the second gap 58 is filled with the third outer circumferential mold 65 in a position which is distanced further from the bottom surface 17 than the second outer circumferential mold 64, even if an external force is applied to the first side surface 15 due to a collision or the like of the recording medium 2, it is possible to further suppress the warping of the first side surface 15. Since the second outer circumferential mold 64 is used to fill a position which is lower than the third outer circumferential mold 65, that is, a position close to the bottom surface 17, it is possible to further reduce the contraction stress which acts on the side surfaces of the head units 13 and arises when the liquid-state mold material cures.

Incidentally, in the embodiments described above, the ribs 29 are provided on each of the head units 13; however, the invention is not limited thereto. A configuration may be adopted in which adjacent ribs protruding toward the second gap are provided in at least the head units which are positioned at the ends in the main scanning direction, among the lined-up head units. The number of the ribs 29 is not limited to two, and three or more may be provided. In other words, if an interval is formed between the ribs only in the regions which are filled with the third outer circumferential mold, it is possible to provide the ribs in other regions, that is, regions other than the regions which are filled with the third outer circumferential mold. By providing a plurality of ribs in this manner, it is possible to further suppress the flowing of the liquid-state mold material which forms the third outer circumferential mold into the third gap side, and to secure the strength of the head case using the ribs.

In the above description, description was given exemplifying an ink jet recording head 3 which is a type of the liquid ejecting head; however, the invention can also be applied to other liquid ejecting heads in which a configuration is adopted in which a plurality of head units are fixed to a fixing plate. For example, it is possible to apply the invention to a color material ejecting head which is used in the manufacture of a color filter of a liquid crystal display or the like, an electrode material ejecting head which is used in forming electrodes of an organic electro luminescence (EL) display, a face emission display (FED), and the like, a bio-organic matter ejecting head used in the manufacture of bio chips (biochemical elements), and the like.

What is claimed is:

1. A liquid ejecting head, comprising:

a head unit configured to eject a liquid from a nozzle which is formed on a nozzle surface;

a fixing plate which includes a bottom surface and a first side surface, the bottom surface fixed to the nozzle surface of each of a plurality of the head units which are provided to line up in a state in which a first gap is remained along a first direction parallel to the nozzle surface, the first side surface extending to the head unit side from an edge of the bottom surface positioned closer to an outside in the first direction than the lined-up head units, and in which a second gap is remained between the first side surface and the head units which are positioned at ends in the first direction among the head units;

a first filler which fills at least a portion of the first gap; and a second filler which fills at least a portion of the second gap, wherein the second filler fills the second gap at a position which is distanced further from the bottom surface than the first filler in a direction which is perpendicular to the bottom surface, and wherein a hardness of the second filler is higher than a hardness of the first filler.

2. The liquid ejecting head according to claim 1, wherein a maximum interval between the head unit and the first side surface in the second gap is narrower than a maximum interval between adjacent head units in the first gap.

3. The liquid ejecting head according to claim 1, wherein the fixing plate includes a second side surface which extends to the head unit side in a state in which a third gap is formed in a space from an edge of the bottom surface, which is positioned closer to an outside than the head unit in a second direction which is parallel with the nozzle surface and orthogonal to the first direction, to the head units, and wherein a maximum interval between the head units and the second side surface in the third gap is narrower than a maximum interval between the head units and the first side surface in the second gap.

4. The liquid ejecting head according to claim 1, wherein, among the lined-up head units, at least the head units which are positioned at ends in the first direction include at least two adjacent ribs protruding toward the second gap to leave an interval in a second direction which is parallel with the nozzle surface and orthogonal to the first direction.

5. The liquid ejecting head according to claim 4, wherein the head unit includes at least two ribs protruding outward from each side in the first direction to leave an interval in the second direction, and wherein the ribs protruding from one side are formed to be shifted in the second direction in relation to the ribs protruding from other side.

6. The liquid ejecting head according to claim 1, wherein a space between the second filler and the bottom surface in the second gap is filled with the first filler.

7. The liquid ejecting head according to claim 6, wherein the first filler is injected from the second gap to fill the first gap and the second gap.

8. A liquid ejecting head, comprising:

a head unit configured to eject a liquid from a nozzle which is formed on a nozzle surface;

a fixing plate which includes a bottom surface, a first side surface and a second side surface, the bottom surface fixed to the nozzle surface of each of a plurality of the head units which are provided to line up in a state in which a first gap is remained along a first direction parallel to the nozzle surface, the first side surface extending to the head unit side from an edge of the bottom surface which is positioned closer to an outside in the first direction than the lined-up head units, and the second side surface extending to the head unit side from an edge of the bottom surface which is positioned closer to an outside in a second direction parallel to the nozzle surface and orthogonal to the first direction, and in which a second gap is remained between the first side surface and the head units which are positioned at ends in the first direction among the head units, and in which a third gap is remained between the second side surface and the head units;

a first filler which fills at least a portion of the first gap; and a second filler which fills at least a portion of the second gap, wherein a maximum interval between the head units and the second side surface in the third gap is narrower than a maximum interval between the head units and the first side surface in the second gap, and wherein a hardness of the second filler is higher than a hardness of the first filler.

9. The liquid ejecting head according to claim 8, wherein, among the lined-up head units, at least the head units which are positioned at ends in the first direction include at least two adjacent ribs protruding toward the second gap to leave an interval in the second direction.

10. The liquid ejecting head according to claim 9, wherein the head unit includes at least two ribs protruding outward from each side in the first direction to leave an interval in the second direction, and wherein the ribs protruding from one side are formed to be shifted in the second direction in relation to the ribs protruding from other side.

* * * * *